United States Patent [19]

Toelle

[11] 4,248,196

[45] Feb. 3, 1981

[54] OPEN LOOP COMPENSATION CIRCUIT

[75] Inventor: Alvin D. Toelle, Fenton, Mich.

[73] Assignee: The Bendix Corporation, Southfield, Mich.

[21] Appl. No.: 35,128

[22] Filed: May 1, 1979

[51] Int. Cl.[3] ..... F02M 51/02

[52] U.S. Cl. ..... 123/489; 123/440

[58] Field of Search ..... 123/119 EC, 32 EE; 60/276, 285

[56] References Cited

U.S. PATENT DOCUMENTS

| | | | |
|---|---|---|---|
| 3,990,411 | 11/1976 | Oberstadt et al. | 123/32 EE |
| 4,121,554 | 10/1978 | Sueishi et al. | 123/32 EE X |
| 4,123,999 | 11/1978 | Asano | 123/119 EC X |
| 4,132,200 | 1/1979 | Asano et al. | 123/119 EC |
| 4,142,482 | 3/1979 | Asano et al. | 123/119 EC X |

*Primary Examiner*—Tony M. Argenbright

*Attorney, Agent, or Firm*—William A. Marvin; Russel C. Wells

[57] ABSTRACT

A closed loop fuel management system is disclosed in which an improved dual integral controller provides both transient and gross correction for an electronic fuel injection system operating at a predetermined air/fuel ratio. The controller has cascaded dual integrators including a primary integrator with a relatively fast integration rate utilized for transient control and a secondary integrator with a relatively slow integration rate utilized for gross control such as ageing effects and altitude compensation. The controller responds to several engine operating conditions and to rich fuel power demands to switch from closed loop to open loop control while maintaining the gross system correction provided by the operating point of the secondary integrator.

20 Claims, 5 Drawing Figures

V14
200
202
204
206
208
210
212
A
Δe
O2
WOT

OPEN LOOP COMPENSATION CIRCUIT

BACKGROUND OF THE INVENTION

The invention pertains generally to closed loop fuel management systems and is more particularly directed to an integral control system that responds to particular engine operating conditions by switching to an open loop operating mode while maintaining a gross system correction provided from a closed loop mode.

Conventional closed loop fuel management systems found on motor vehicles today utilize a bilevel oxygen gas sensor responding to the constituent presence or absence of oxygen in the exhaust gas of the engine. These closed loop fuel management systems generally include an integral controller which increases and decreases the air/fuel ratio above and below the stoichiometric value according to the bilevel sensor signal. A characteristic limit cycle oscillation is generated which centers the air/fuel ratio average near the stoichiometric value.

It is known that these integral control systems provide a closed loop correction or compensation for the open loop portion of an electronic control unit which responds to measured engine operating conditions such as mass air flow. The open loop portion is used to calculate a quantity of fuel to be input to the engine from the measured parameters and schedules a predetermined air/fuel ratio, usually stoichiometric therefrom. For emission control a three-way catalytic converter with a narrow air/fuel ratio conversion window is commonly included in such a system. The closed loop control adaptively interacts with the open loop portion and retains the scheduled air/fuel ratio within the well defined narrow air/fuel ratio limit for the efficient reduction of exhaust emissions by the catalytic converter.

An advantageous example of such an integral controller is shown in U.S. Pat. No. 3,990,411 issued Nov. 9, 1976 to Oberstadt et al., which is commonly assigned with the present invention and the disclosures of which is hereby incorporated by reference herein.

In Oberstadt et al., a cascaded controller is disclosed where primary and secondary integrators are used in a closed loop control mode. The primary integrator, which has a relatively fast integration or ramp rate, is utilized for transient control and rapidly follows an indication of a need to correct the air/fuel ratio. Such a fast integration rate, however, with the inherent system lags in the integral control law will produce large air/fuel ratio excursions if the primary integrator is allowed to have a significant authority. Such large excursions would exceed the bounds of the narrow band of air/fuel ratios necessary for efficient catalytic conversion.

Thus, a secondary integrator with a relatively slow integration or ramp rate is used for gross control and has a much larger authority level than the primary integrator. The secondary integrator is used primarily for compensating the ageing effects of the engine and for altitude compensation which produce slowly varying but large or gross changes in the need for air/fuel ratio correction of the open loop calibration. The secondary integrator can be envisioned as providing a gross operational offset around which the primary integrator can limit cycle.

One useful feature of the Oberstadt et al. system is its ability to switch from closed loop to open loop control while detecting certain special engine conditions and rich fuel power demands. Generally, the more important of these conditions are at idle, wide open throttle, and when the engine operating temperature is cold. During these periods, the engine generally will require a richer air/fuel ratio than the stoichiometric value that the closed loop mode provides and the system is switched to an open loop mode to output this value. Normally, this switching from closed loop to open loop control provides an advantageous system whereby the system operates most of the time in the narrow band around stoichiometric, and only when the particular special engine operating conditions are detected does it generate a richer air/fuel ratio. The primary and secondary integrator are clamped to noncorrectional values during this open loop mode of operation.

It is now recognized, however, that the secondary integrator which provides the gross operational control of the system is necessary for correction of the open loop air/fuel ratio even during those special engine operating conditions mentioned above. When operating at the predetermined richer air/fuel ratio generated for these conditions, ageing factor and altitude compensation corrections are needed just as much as they are needed when the system is acting under closed loop control. The information necessary for developing these corrections is stored as the instantaneous operating point of the secondary integrator. The conditions which cause the voltage level to vary on the secondary integrator may build over long time periods and can cause significant air/fuel ratio errors when running open loop if the correction is not utilized. However, in the present Oberstadt et al system this information is lost when the system switches into an open loop mode of operation by clamping the integrators and must be regenerated upon the return to closed loop control.

Further, because the secondary integrator has a slower integration rate and a much greater authority than the primary integrator, once the special conditions cease and switching back to closed loop control occurs, the Oberstadt et al. system responds relatively slowly in regaining the operational point of the secondary integrator. The greater the original gross correction, the longer it will take for the system to regenerate the correction and the greater the air/fuel ratio error will be during the delay.

Therefore, it would be highly desirable to maintain open loop system control during special engine operating conditions while providing the secondary integrator operating point as a correction of value to the open loop control. As a consequence a faster and more facile switching back into the closed loop mode would also be obtained by such control because the gross correction would not have to be regenerated.

SUMMARY OF THE INVENTION

A closed loop air/fuel ratio management system is provided by the invention in which a cascaded integral controller provides both transient and gross system correction while operating at a predetermined air/fuel ratio. Preferably, the integral controller operates the system at stoichiometric air/fuel ratio during a substantial portion of the operation of the system in a closed loop mode. The system includes means responding to several special engine conditions and to rich fuel power demands for switching from the closed loop mode to an open loop mode and a relatively rich air/fuel ratio. The switching is accomplished by clamping the primary integrator to a noncorrectioned value during the special conditions by a clamp circuit. Further included in the switching means is a hold circuit for maintaining the gross system correction provided by the operating point of a secondary integrator during the open loop operation.

Therefore, it is an object of the invention to provide a closed loop integral controller which maintains a closed loop correction during special conditions of the engine in an open loop mode.

It is another object of the invention to provide this closed loop correction as a secondary integrator operational point during the special conditions of idle, wide open throttle and cold engine conditions.

It is still another object of the invention to provide the secondary integration operating point as an initializing value with which to begin the closed loop control after returning from open loop control.

Still further, it is an object of the invention to provide a faster responding closed loop control which returns quickly to the predetermined air/fuel ratio after responding to the special engine operating conditions.

These and other objects, features, and aspects of the invention will be more fully understood and better described if a reading of the following detailed description is undertaken in conjunction with the appended drawings wherein:

DETAILED DESCRIPTION OF PREFERRED EMBODIMENT

Figure 1:
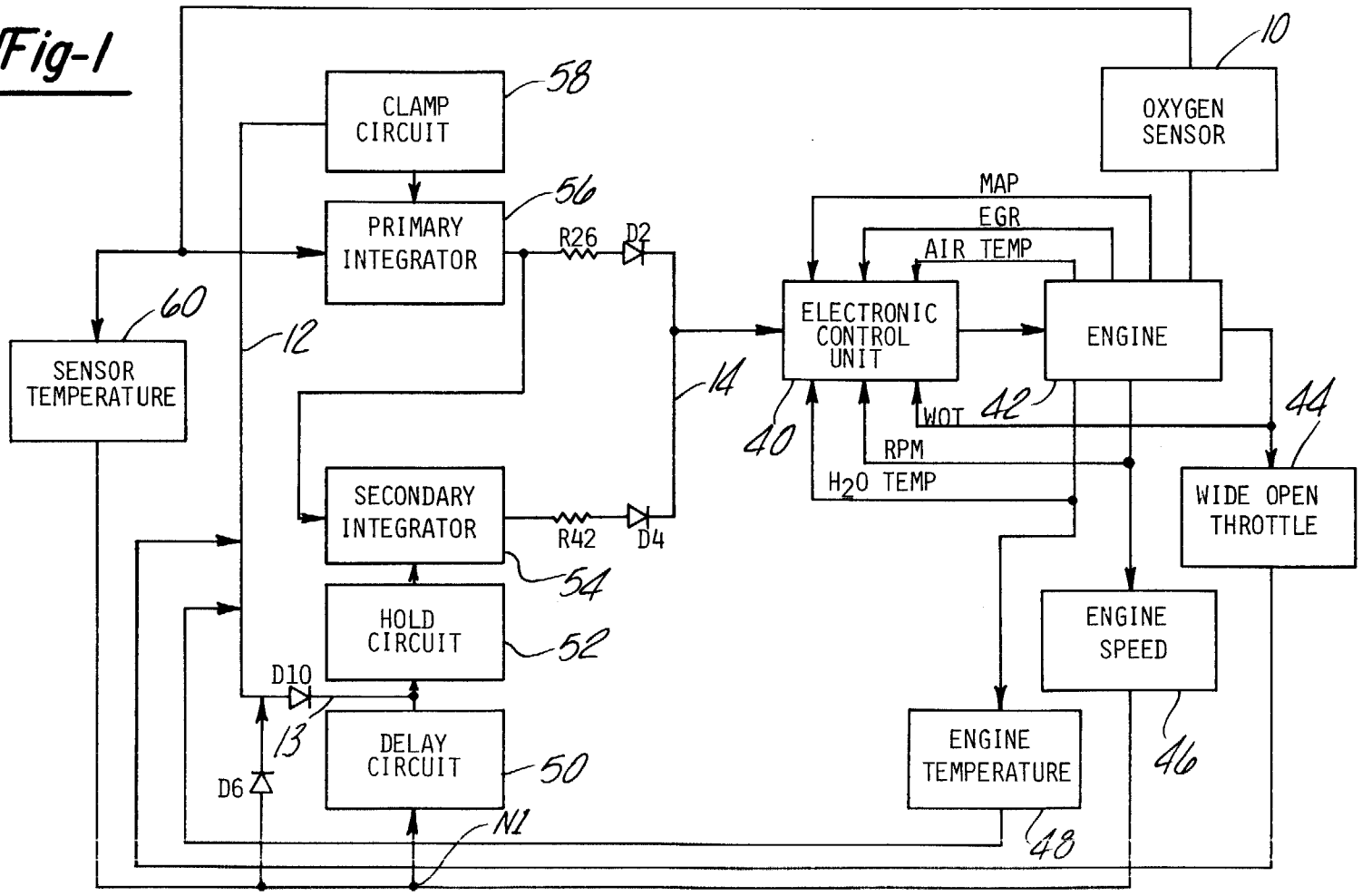
FIG. 1 is a system block diagram of a closed loop fuel management system which is constructed in accordance with the invention.

The closed loop air fuel ratio management system will now be more fully disclosed with reference to the system block diagram of FIG. 1. An electronic control unit 40 is used to produce a fuel metering signal to an internal combustion engine 42 and regulate a fuel metering device of the engine in an open loop mode. As is known the fuel metering device of the engine (not illustrated) can be sequential or group fired electronic fuel injectors, a single-point metering system utilizing electronic fuel injectors, or an electronic carburetor.

The metering signal is developed from an open loop schedule of the electronic control unit 40 from the input of various engine operating parameters; for example, the manifold absolute pressure (MAP), the exhaust gas recirculation (EGR), the ambient air temperature (AIR TEMP), a signal indicating the wide-open position of the throttle (WOT), the operating speed of the engine (RPM) and the temperature of the coolant of the engine ($H_2O$-TEMP).

The operating parameters describe the fuel quantities that should be input by the fuel metering device to generate the scheduled air/fuel ratio for the instantaneous operating point sensed. As the operating point shifts a different quantity of fuel will be scheduled to match the changed conditions and maintain the desired air/fuel ratio. The open loop schedule of the electronic control unit 40 is generally calibrated for an ideal engine and for sea level or near sea level altitudes. Since no production engine will meet this ideal and any engine is constantly changing due to the ageing effects of wear and maintenance, the open loop calibration will be slightly off of the intended value. Moreover, transient operating conditions and operation at nonstandard altitudes will cause open loop air/fuel ratio errors.

To compensate or correct the open loop schedule there is supplied a closed loop integral controller. The closed loop integral controller is adaptive and closes the loop around a parameter indicative of the actual air/fuel ratio. Preferably for the system shown the parameter is the constituent oxygen content of the exhaust gas. If the measured air/fuel ratio is less than a desired predetermined value the integral controller will increase it and similarly if it is greater than the predetermined value decrease it. The inherent delay from the time the air/fuel ratio is changed by the controller until the time its effects can be measured will cause some overshoot of the predetermined value and set up the characteristic limit cycle oscillation of the system.

The integral controller disclosed comprises mainly a primary integrator 56 and a secondary integrator 54. The primary integrator 56 receives an input signal from an oxygen sensor circuit 10 and integrates this signal to provide a primary correction signal via resistor R26 and diode D2 to the signal line 14. The output of the oxygen sensor circuit 10 is a bilevel signal indicating the relative abundance or substantial absence of oxygen in the exhaust manifold of the engine. When integrated this signal produces from the primary integrator 56 a positive or negative going ramp voltage about a midpoint voltage.

The output signal from the primary integrator 56 is further integrated in the secondary integrator 54 which outputs a secondary correction signal via resistor R42 and diode D4 to the signal line 14. The secondary integrator integrates a bilevel signal derived from the primary correction signal indicating whether the primary integrator is above or below its midpoint. The control signals from the primary and secondary integrators are thereafter combined into a composite signal to control the electronic control unit in a closed loop mode. The composite signal can be either a current or a voltage which causes the electronic control unit 40 to incrementally change the air/fuel ratio in accordance with the control law of the system.

Generally the primary integrator has a relatively fast integration rate and will limit cycle the air/fuel ratio around a predetermined set point of the oxygen sensor circuit which is at or near a stoichiometric air/fuel ratio. The secondary integrator 54 which has a relatively slow ramp rate is generally masked by the greater ramp rate of the primary but is constantly changing. However, the secondary integrator will dominate the correction if the authority level of the primary integrator is exceeded. The primary integrator thus cycles about a gross system correction voltage set by the secondary integrator which is related to long-term ageing and wear effects and possibly altitude compensation if the engine is being operated at nonstandard altitude.

During special engine conditions, preferably idle as sensed by engine speed circuit 46, wide-open throttle as sensed by wide-open throttle circuit 44, a cold engine temperature as sensed by engine temperature circuit 48, or a nonoperative oxygen sensor as detected by sensor temperature circuit 60, the integral controller will switch to an open loop mode. The switching is effected by a high level signal from any of special condition circuits through signal lines 12 and 13 to a switching circuit including clamp circuit 58 and a hold circuit 52. The primary integrator 56 will be clamped to its mid-point value to provide no correction during the special conditions by the clamp circuit 58. During this time, the oxygen sensor circuit signal will not regulate the primary integrator output and the system will be operating from the open loop schedule of the electronic control unit 40. Also operative during these special conditions is the hold circuit 52 which will cause the secondary integrator 54 to stop or halt its integration. According to the invention the hold circuit 52 will maintain the operational point of the secondary integrator at a stationary point to provide gross system correction via line 14 during the open loop mode of operation.

Once the special conditions which are sensed cease, and the output signal from the special condition circuits go low the clamp circuit 58 will allow the primary integrator to integrate the oxygen sensor signal and the hold circuit 52 will release the secondary integrator. The primary and secondary integrators will be operational to provide closed loop control.

Additionally, for the signals generated by the sensor temperature circuit 60 and engine speed circuit 46, a delay circuit 50 is interposed between the hold circuit 52 and the incoming signals to provide a time delay before the secondary integrator is released after these conditions cease. The control of the delay circuit 50 is provided by two steering diodes D6, D10 which transmit the high level signals from the engine speed circuit 46 and sensor temperature circuit 60 to operate the hold circuit 52, clamp circuit 58, and delay circuit 50 simultaneously but block the other special condition signals from operating the delay circuit and the output of the delay circuit from operating the clamp circuit 58.

Figure 2:
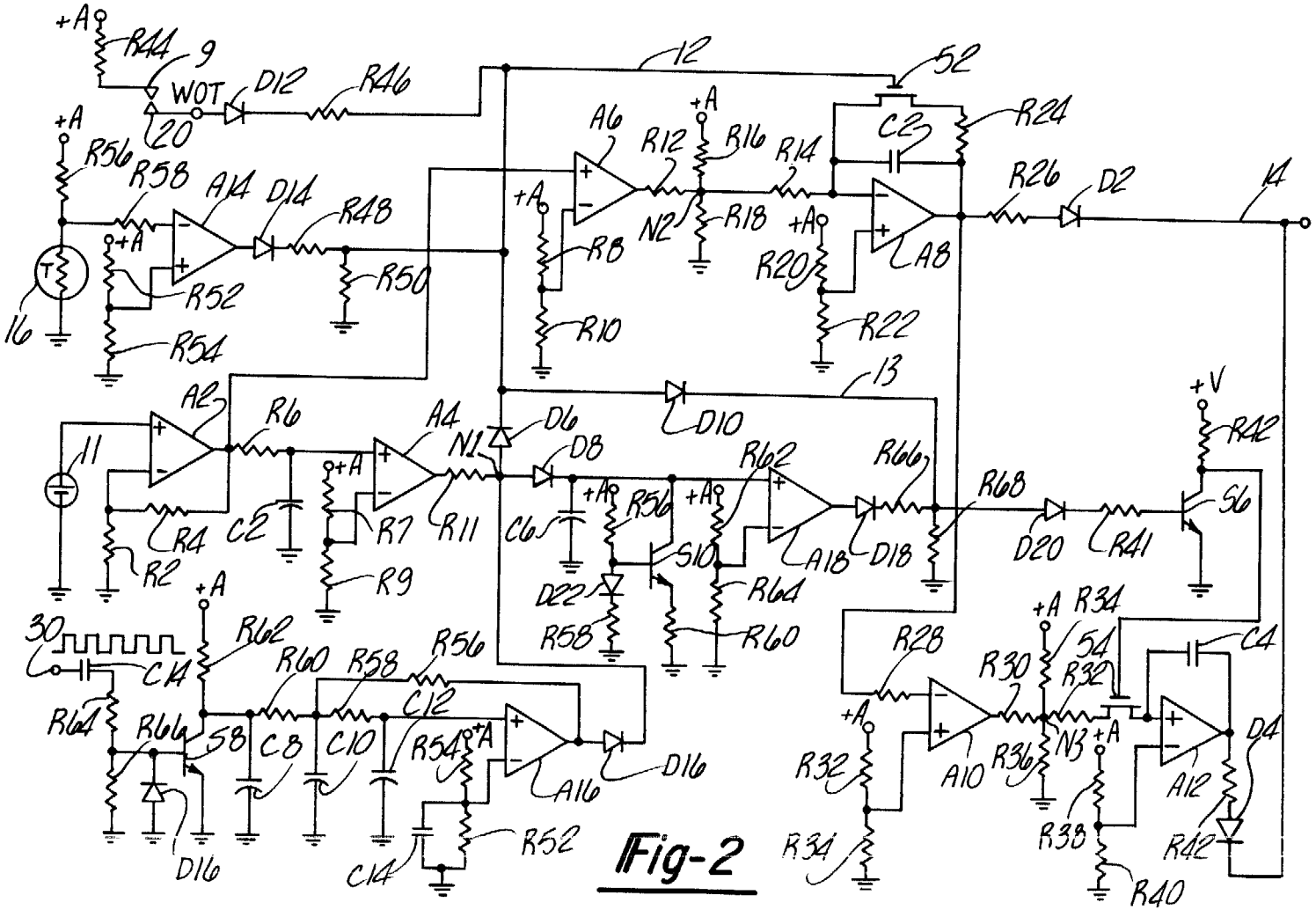
FIG. 2 is a detailed circuit schematic of the closed loop integral controller for the fuel management system illustrated in FIG. 1; and FIGS. *3a–c* are illustrative waveform diagrams of representative signals at various points in the circuit of FIG. 2 as will be more fully explained hereinafter.

With respect now to FIG. 2, there is illustrated the detailed circuit diagram of the integral controller previously described. The oxygen sensor circuit 10 includes an exhaust gas sensor 11 located preferably in the exhaust manifold of the engine which is connected to the noninverting input of a voltage amplifier A2 at one lead and ground at the other lead. As is conventional, the exhaust gas sensor 11 produces a bilevel switching signal $O_2$ with a sharply defined transitional edge occuring substantially at the instant the sensor detects from the oxygen content of the exhaust gases that a stoichiometric air/fuel ratio has been previously combusted. The amplifier A2 has a pair of feedback resistors R2 and R4 connected between its output terminal and ground. The junction of the feedback resistors R2 and R4 is connected to the inverting input of the amplifier A2. The Amplifier A2 thus operates as a noninverting linear amplifier to provide voltage gain for the bilevel signal $O_2$ from the exhaust gas sensor 11.

The output of the amplifier A2 is fed to the primary integrator at the noninverting input of a thresholding comparator A6. The primary integrator comprises the comparator A6 and an integrating Amplifier A8 with their associated circuitry. The comparator A6 thresholds the signal from the exhaust gas sensor and transmits it to the integrating amplifier A8. The threshold is developed at the inverting input of the amplifier A6 by connection to the junction of a pair of divider resistors R8 and R10 connected between a source of positive voltage +A and ground. The junction of the divider is set at the value of air/fuel ratio at which the primary integrator will regulate the system. This air/fuel ratio is generally stoichiometric or within a very narrow range near stoichiometric, as the slope of the sensor signal is extremely fast.

The output of the comparator A6 is transmitted via a resistor R12 to the input resistor R14 of the integrating amplifier A8. The junction between the resistors R12 and R14 is provided with a mid-value voltage by connecting a pair of divider resistors R16 and R18 between a source of positive voltage +A and ground. This mid-value is the voltage from which the primary integrator will provide increases and decreases in air/fuel ratio as the comparator amplifier A6 switches between positive and negative outputs. The mid-value voltage will produce no closed loop correction for the system.

The integrating amplifier A8 includes an integrating capacitor C2 connected between its inverting input and output and further has a threshold voltage supplied to its noninverting input from the junction of a pair of divider resistors R20 and R22 connected between the source of positive voltage +A and ground. The threshold of the amplifier A8 is set to be equivalent to the mid-value voltage. The output of the primary integrator is supplied to the electronic control unit 40 via the resistor R26 and the serially connected blocking diode D2 through terminal 14. The value of the resistor R26 controls the authority of the primary integrator and resistor R14 the ramp rate.

The clamping circuit 58 comprises a resistor R24 and a switching device 52 connected serially between the output of the amplifier A8 and its inverting input. The switching device 52 preferably is a field effect transistor as shown. Operationally, when a positive voltage signal is applied to signal line 12 from any of the special condition circuits, the switching device 52 will become conducting and discharge the capacitor C2 through the resistor R24 to essentially clamp the primary integrator to the midvalue voltage. The midvalue voltage output is the result of the amplifier A8 having a unity gain provided by the ratio of R24/R12 when clamped.

The output signal of the primary integrator is supplied to the secondary integrator through an input resistor R28 at the inverting input of amplifier A10. The secondary integrator is basically configured similar to the primary integrator and comprises amplifier A10 and amplifier A12 with their associated circuitry. The amplifier A10 acts as a thresholding comparator and supplies a bilevel signal via resistor R30 and a normally conductive switching device 54 to the integrating amplifier A12. The threshold for the amplifier A10 is supplied from the junction of a pair of divider resistors R32 and R34 connected between the source of positive voltage +A and ground. The threshold voltage in this case is supplied as equivalent to the midvalue of the primary integrator.

The output from the amplifier A10 indicates at one level the primary integrator is above the mid-value point and at the other it is below it. Another mid-value voltage level is developed at the node N3 from the junction of divider resistors R34 and R36 connected between positive supply +A and ground. The voltage at N3 centers the operation of the secondary integrator about the mid-value point as the primary integrator. The integrating amplifier A12 has a capacitor C4 connected between its output and noninverting input and a threshold voltage applied to the inverting input. The threshold is set equivalent to the midvalue voltage of the primary integrator and is developed from the junction of divider resistors R30 and R40 connected between the positive supply +A and ground. The output of the integrator amplifier A12 is received by the electronic control unit via terminal 14 through the blocking diode D4 and the serially connected resistor R42. The resistor R42 controls the authority of the secondary integrator and resistor R32 its ramp rate.

The hold circuit comprises the switching device 54 and a switching device 56. The switching device 54 is normally closed or in a conducting state because of the connection of its control terminal to a source of positive bias; namely, a positive voltage +V through a terminal of load resistor R42. The other switching device S6, which in the preferred embodiment is a NPN bipolar transistor, has its collector connected to the same terminal of the load resistor R4 and its emitter connected to ground. The switching device 56 receives signals representative of the special engine conditions at its base through serially connected diode D20 and resistor R40. High levels of the special condition signals control the switching device S6 to ground the positive bias from the load resistor R42 and turn off switching device 54.

The operation of switching device S6 therefore causes switching device 54 to become conducting or nonconducting to connect or disconnect the output of amplifier A10 to the input of amplifier A12.

Operationally, the secondary integrator operates normally when switching device 54 is conducting, but when a special engine condition is detected the disconnection of the input holds the voltage in the capacitor C4. The voltage stored is the secondary integrator operational point and is thereafter used during the open loop operation. Further, when the special condition ceases and switching device 54 becomes conductive, the secondary integrator will start operation from the voltage stored in capacitor C4.

The special condition circuits which operate the switching device 52 to clamp the primary integrator to its mid-point value and further operate switching device 54 to hold the operating point of the secondary integrator will now be more fully explained.

The first of these special conditions circuits is for a wide open throttle condition which is represented by a signal WOT. Normally open contacts 18 and 20 of a switch associated with the throttle close when the throttle attains the wide open position to deliver a positive voltage level indicating the condition via resistor R44. A serially connected resistor R46 and blocking diode D12 transmits the high level WOT signal via signal lines 12 and 13 to turn on switching device 52 and turn off switching device 54 during this condition.

Another special condition circuit the engine temperature circuit, comprises an amplifier A14 which outputs a high voltage level through the blocking diode D14 and the combination of scaling resistors R48 and R50 to signal line 12 and signal line 13. The amplifier A14 is a thresholding comparator which indicates to the control system by a high or low voltage whether the engine has sufficiently warmed to operating temperature.

The engine temperature is sensed by a variable resistance temperature sensor 16 which is generally located in the engine coolant of the internal combustion engine. The noninverting input of the amplifier A14 is connected to a threshold voltage developed at the junction of a pair of divider resistors R52 and R54 connected between a source of positive voltage +A and ground. The threshold voltage is indicative of the standard engine operating temperature at which the internal combustion engine should be thereafter run in a closed loop mode. The threshold voltage is compared to the voltage at the noninverting terminal which derives its signal from resistor R58 via the junction of the series combination of R56, a resistor and the temperature sensor 16 connected between the source of positive voltage +A and ground.

While the engine temperature is colder than the threshold, a positive output of the amplifier A14 will clamp the primary integrator to its mid-value point and hold the secondary integrator to its last operational value. The output of amplifier A14 will transition to a low voltage value thereby releasing the hold circuit and clamp circuit when the engine temperature reaches the standard operational point and exceeds the threshold value.

A third special condition circuit, the engine speed circuit, is provided by an amplifier A16 with associated circuitry which provides a high signal to clamp the primary integrator and to hold the secondary integrator when the internal combustion engine operates at an idle condition. The engine speed circuit will release the hold circuit and the clamp circuit when the engine is operating above that engine speed. The idle condition is sensed by providing a threshold voltage to the inverting input of the amplifier A16 which is representative of the idle speed. The voltage is supplied from the junction of a pair of divider resistors R54, R52 connected between a source of positive voltage +A and ground. In addition, a filter capacitor C14 is connected between the inverting input and ground. Compared to the idle threshold is a voltage from a series of parallel connected capacitors C8, C10, and C12 which are connected by resistors R60 and R58 respectively and charge according to their RC time constants through a resistor R62 from the source of positive voltage +A. A full charge on the capacitors is enough to overcome the idle threshold and provide a high voltage level from amplifier A16.

A speed signal RPM is received via terminal 30 whose frequency is representative of the revolutions per minute of the engine. Each speed pulse is differentiated by a serial differentiator comprising the cpacitor C14 and a resistor R16 connected between the base of a NPN switching transistor S8 and the terminal 30. The spikes from the differentiation of the input pulses develop a voltage across the parallel connection of a resistor R66 and a clipping diode D16 connected between the base of the transistor S8 and ground. Each spike will cause the transistor S8 to conduct for a predetermined period of time and discharge the capacitors C8–C12 by a certain amount.

Once the speed pulses pass the idle frequency, the capacitors will discharge enough to pull the noninverting input of the amplifier A16 below the threshold and the clamping and holding action of the system will cease. A hysteretic resistor R56 changes the speed at which the circuitry will switch to prevent switching during decelerations.

Another special condition circuit is the temperature sensor circuit 60 which comprises an amplifier A4. The amplified signal $O_2$ is fed to the sensor temperature circuit which includes a low pass filter consisting of a resistor R6 connected to one terminal of a capacitor C2 whose other terminal connected to ground. The low pass filter R6, C2 filters out any high frequency noise that is found on the amplified signal. The filtered output signal from the exhaust gas sensor 11 is thereafter fed into the noninverting input of a thresholding comparator A4. The threshold voltage for the comparison, developed at the junction of a pair of divider resistors R7 and R9 connected between the positive supply +A and ground, is input to the inverting input of Amplifier A4.

The threshold voltage is set to provide a high voltage level from Amplifier A4 to node N1 until the output of the amplifier A2 exceeds the threshold. When the exhaust gas sensor 11 is cold or inoperative it will produce a smaller signal than when fully operational and up to temperature. Amplifier A4 signals this condition by holding a high level until a sufficient signal is detected and then switching to a low voltage level at node N1.

The delay circuit comprises an amplifier A18 and associated circuitry which generates a high level signal through a diode D18 and a resistor R66 for a predetermiend period of time after the output of amplifier A16 or the output of amplifier R11 transitions to a low state. A threshold voltage, applied to the inverting input from the junction of a pair of divider resistors R62 and R64 connected between the positive supply +A and ground, maintains the output of amplifier A18 in a low signal level. When either Amplifier A16 or Amplifier A4 produces a high level output a capacitor C6 is charged through diode D8. The voltage on the capacitor C8 applied at the noninverting input overcomes the threshold at the inverting input and switches the amplifier A18 to a high level. The amplifier A18 will transition to a low level after a transistor S10 discharges the capacitor C6 through a resistor R60 to a voltage level below that of the threshold. The transistor is constantly conducting a set amount of current as a result of a forward bias network comprising the serial combination of a resistor R56, a diode D22, and a resistor R58 connected between the positive supply +A and ground. The bias network is connected at the junction of the diode D22 and resistor R56 to the base of the transistor S10.

Figures 3A, 3B, 3C:
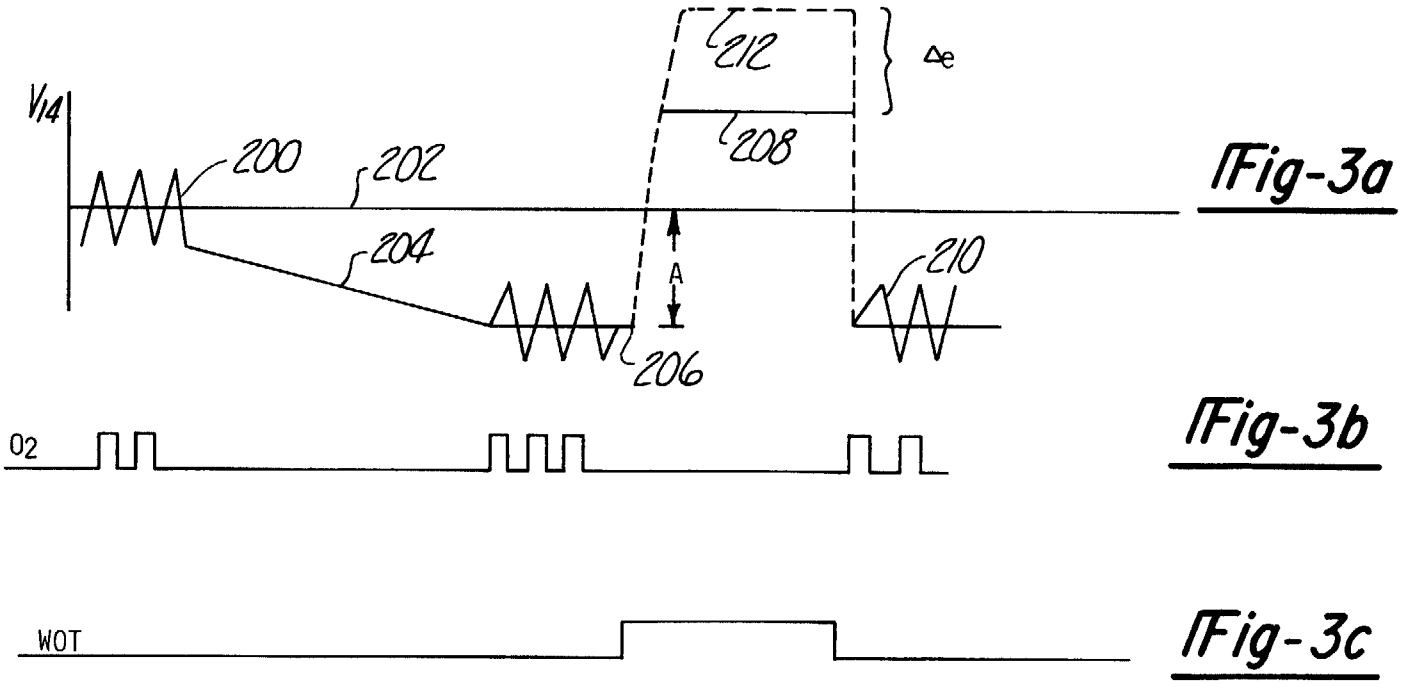

With respect now to FIG. 3*a*, there is shown the representative waveshape for the composite of the correction signals of the integral controller from signal line 14. The primary integrator correction signal having a waveshape 200 is shown oscillating in a closed loop limit cycle about a voltage level 202. The primary integrator waveshape 200 is based on the oxygen sensor signal $O_2$ illustrated in FIG. 3*b*. It is seen that the primary integrator changes ramp direction for every transition in the $O_2$ signal at the stoichiometric air/fuel ratio. As the primary integrator correction signal ramps upwardly an incrementally richer air/fuel ratio is generated and as the primary integrator correction signal ramps downwards an incrementally leaner air/fuel ratio is generated. Voltage level 202 is the mid-point value around which both integrators are centered and represents a voltage level where no correction to the air/fuel ratio will be applied. The waveform 202 represents the closed loop correction of an accurate open loop schedule operating at its calibrated altitude.

When the system ages, or the barometric pressure changes or transients occur, the authority of the primary integrator 56 is exceeded and the scheduled open loop air/fuel ratio can no longer be caused by a correction voltage from the primary integrator centered at 202. The secondary integrator therefore ramps along a line 204 to find a new correctional voltage that will bring the system back into calibration. If the change is slow enough the primary integrator will limit cycle around the value set by the secondary integrator. A new level 206 is found at some point and the primary integrator will again begin to limit cycle about this operational point. The difference between the original mid-point value of the primary integrator at 202 and the new level at 206, level A, is the gross correctional voltage produced by the secondary integrator and stored on its integrating capacitor.

For any one of the special conditions that occur, such as wide-open throttle, indicated by the positive transition of the WOT signal in FIG. 36 a predetermined change in air/fuel ratio will be made by the open loop schedule of the electronic control unit.

For example, normally a change from level 202 to 212 by the open loop scheduler would provide a rich air/fuel ratio for the duration of the wide-open throttle signal. However, because the operating point of the system has changed to level 206, an error E equal to level A will occur if the scheduled open loop increment is added to the level 202. Therefore, the present system corrects this error by holding the secondary integrator operating point at 206 during the special engine condition thereby providing compensation the magnitude of A to the metering signal provided at wide-open throttle conditions.

The result of the system operation is a corrected level 208 which produces the richer air/fuel ratio that is needed during the wide-open throttle conditions but without generating excessive pollutants with an overly rich ratio. Once the wide-open throttle signal ceases, the system begins its closed loop operation at the level 206 which permits the primary integrator to begin its cyclic oscillation at 210 without the need to redevelope the secondary integrator operating point.

The system shown illustrates an analog integral controller using the control law disclosed. It would, however, be well within the ordinary skill of the art to provide such a controller as disclosed in a digital form. If the controller is implemented in a digital form the secondary integrator operating point may be stored in a nonvolatile register or memory for initialization purposes and holding. The need to regenerate the gross correction for every start up period as when switching back to the closed loop mode of operation would then be obviated.

Thus, while a preferred embodiment of the present invention has been shown and described, it will be obvious to those skilled in the art that it should not be so limited as the embodiment will be susceptible to various changes and modifications in the particular aspects thereof without departing from the spirit and scope of the invention as will be claimed hereinafter.

What is claimed is:

1. A closed loop air/fuel ratio management system for an internal combustion engine having an open loop air/fuel ratio controller, said closed loop system comprising;

a primary integrator circuit for compensating transient conditions of the open loop controller based upon the oxygen content of the exhaust gas of the internal combustion engine; said primary integrator circuit generating a primary correction signal to the open loop controller which causes the air/fuel ratio to increase when there is a relative absence of oxygen in the exhaust gas and to decrease the air/fuel ratio when there is a substantial presence of oxygen in the exhaust gas, said primary correction signal forming a limit cycle about a noncorrectional value;

a secondary integrator circuit for compensating gross conditions of the open loop controller based upon said primary correction signal, said secondary integrator circuit generating a secondary correction signal to the open loop controller which causes the air/fuel ratio to increase when said primary correction signal is greater than said noncorrectional value and to decrease when said primary integrator is less than said noncorrectional value;

means for clamping said primary integrator to its noncorrectional value during at least one special engine condition, said clamping means releasing said primary integrator upon the cessation of said special engine condition; and means for holding said secondary integrator during said engine condition to generating said secondary correctional signal as the last instantaneous operating point of said secondary integrator before the condition occured, said holding means releasing said secondary integrator upon the cessation of said special engine condition.

2. An air/fuel ratio management system as defined in claim 1 wherein said secondary integrator comprises:

an operational amplifier including an integrating capacitor connected between one input terminal and the output terminal of said amplifier; said one input terminal being electrically connected to the primary correctional signal through a switching device; and said holding means includes said switching device.

3. An air/fuel ratio management system as defined in claim 2 wherein said holding means further includes;

means for normally biasing said switching device into a conducting state, and means electrically connected to said biasing means for terminating the biasing to said switching device in response to said special engine condition in order to switch said switching device into a nonconducting state.

4. An air/fuel ratio management system as defined in claim 3 wherein said switching device is a field effect transistor with one power terminal connected to said one input terminal of said amplifier and the other power terminal electrically connected to said primary correction signal.

5. An air/fuel ratio management system as defined in claim 4 wherein said biasing means include:

a resistor connected between a source of voltage and the control terminal of said field effect transistor.

6. An air/fuel ratio management system as defined in claim 5 wherein said termination means includes a NPN transistor with its collector terminal connected to said control terminal and its emitter terminal connected to ground, said transistor having a base terminal receiving a signal indicative of the presence of said special engine condition to cause said transistor to conduct.

7. An air/fuel ratio management system as defined in claim 1 wherein:

said special engine condition is where the throttle of the engine is in a wide open position.

8. An air/fuel ratio management system as defined in claim 7 wherein:

another special engine condition is where the engine is operating at an idle speed.

9. An air/fuel ratio management system as defined in claim 8 wherein:

another special engine condition is where the temperature of engine is below the standard operating temperature of the engine.

10. A method of air/fuel ratio management for an internal combustion engine comprising the steps of:

correcting for the transient errors of a scheduled air/fuel ratio based upon the oxygen content of the exhaust gas of the engine;

correcting for the gross errors of said scheduled air/fuel ratio based upon said transient correction;

sensing at least one special engine condition;

clamping said transient correction to a noncorrectional value during said special operating condition; and holding said gross correction stationary during said special operating condition.

11. A method of air/fuel ratio management as defined in claim 10 wherein said step of sensing at least one special engine condition includes;

sensing a condition where the throttle of the engine is in a wide-open position.

12. A method of air/fuel ratio management as defined in claim 11 wherein said step of sensing at least one special engine condition further includes:

sensing a condition where the temperature of the engine is less than the standard operating temperature.

13. A method of air/fuel ratio management as defined in claim 12 wherein said step of sensing at least one special engine condition further includes:

sensing a condition where the engine is operating at an idle speed.

14. A method of air/fuel ratio management as defined in claim 10 wherein:

said step of correcting for the transient errors includes the step of integrating a first bilevel signal where one level represents the relative absence of oxygen in the exhaust gas of the engine and the other level represents the substantial presence of oxygen in the exhaust gas of the engine.

15. A method of air/fuel ratio management as defined in claim 14 wherein:

said step of correcting for gross errors includes the step of integrating a second bilevel signal where one level represents that said transient correction is increasing said air/fuel ratio above said scheduled ratio and the other level represents that said transient correction is decreasing said air/fuel ratio below said scheduled ratio.

16. A method of air/fuel ratio management as defined in claim 15 wherein:

said step of integrating a bilevel signal occurs at a relatively fast integration rate and is limited to a relatively small absolute magnitude compared to the integrating rate and absolute magnitude of said step of integrating a second bilevel signal.

17. A method of air/fuel ratio management as defined in claim 16 wherein:

said step of clamping said transient correction includes the step of discharging a primary integrating capacitor on which said transient correction is stored to a noncorrecting potential.

18. A method of air/fuel ratio management as defined in claim 17 wherein:

said step of holding said gross correction includes the step of disconnecting said second bilevel signal to a secondary integrating capacitor on which said gross correction is stored.

19. A method of air/fuel ratio management as defined in claim 18 wherein:

said step of disconnecting said second bilevel signal includes the step of biasing a switching device connected between said second bilevel signal and said integrating capacitor into a nonconducting state in response to said special engine condition.

20. A method of air/fuel ratio management as defined in claim 19 wherein:

said step of biasing includes the step of grounding the control terminal of said switching device which is connected to a forward biasing network.

* * * * *